US006119602A

United States Patent [19]

Yoshino

[11] Patent Number: 6,119,602

[45] Date of Patent: Sep. 19, 2000

[54] AXLEBOX SUSPENSION SYSTEM FOR BOGIE TRUCK

[75] Inventor: Masao Yoshino, Tokyo, Japan

[73] Assignee: Urban Culture Institute Co., Inc., Tokyo, Japan

[21] Appl. No.: 09/051,841

[22] PCT Filed: Oct. 17, 1997

[86] PCT No.: PCT/JP97/03765

§ 371 Date: Apr. 22, 1998

§ 102(e) Date: Apr. 22, 1998

[87] PCT Pub. No.: WO98/17520

PCT Pub. Date: Apr. 30, 1998

[30] Foreign Application Priority Data

Oct. 24, 1996 [JP] Japan ..... 8-282434

[51] Int. Cl.[7] ..... B61F 15/00; B61F 5/26

[52] U.S. Cl. ..... 105/218.1; 105/167; 105/224.05; 105/224.06

[58] Field of Search ..... 105/167, 168, 105/218.1, 219, 220, 222, 224.05, 224.06, 224.1

[56] References Cited

U.S. PATENT DOCUMENTS

| | | | |
|---|---|---|---|
| 4,561,360 | 12/1985 | Mulcahy . | |
| 4,742,779 | 5/1988 | Bevand | 105/167 |
| 5,174,218 | 12/1992 | List | 105/185 |

FOREIGN PATENT DOCUMENTS

| | | |
|---|---|---|
| 0368403 | 5/1990 | European Pat. Off. . |
| 2023523 | 1/1980 | United Kingdom . |

*Primary Examiner*—S. Joseph Morano
*Assistant Examiner*—Robert J. McCarry, Jr.
*Attorney, Agent, or Firm*—Pitney, Hardin, Kipp and Szuch LLP

[57] ABSTRACT

In a bogie truck for a railroad vehicle, provided is an axlebox suspension system in which respective wheelsets can make rotational displacement toward the center of a curve in the railroad at the time of passage of the truck through the curve in the railroad. A laminated rubber spring body (10) having, as a guide surface, a partial curved surface of a perpendicular cylinder (A) with the center of gravity of each wheelset (4) as its center (O) is used as a connection material to be disposed between a truck frame (1) and an axlebox (5).

5 Claims, 12 Drawing Sheets

AXLEBOX SUSPENSION SYSTEM FOR BOGIE TRUCK

BACKGROUND OF THE INVENTION

1. Field of the Invention

The present invention relates to a bogie truck axlebox suspension system for a railroad vehicle and particularly relates to an axlebox suspension system adapted to a truck which needs a steering function.

2. Prior Art

A conventional railroad vehicle is designed so that each pair of left and right wheels are fixed to a corresponding axle so as to rotate at equal rotational speeds. Further, in the conventional railroad vehicle, there are provided slopes called "wheel treads" at contact portions between the wheels and rails so that, when the wheels run on curved portions of the rails, a corresponding wheelset is displaced to the outside of the curve by the action of centrifugal force, or the like, to thereby cause a difference between the turning radii of inner and outer wheels to suppress the sliding of the inner and outer wheels on the rails to be in a fine range. Further, in the case of an acute curve in the railroad, enlargement of the distance between railroad tracks, which is called "slack", is provided so that the difference between the turning radii of the inner and outer wheels increases more greatly. Thus, as described above, the wheels per se have self-steering property. A conventional bogie truck is, however, characterized in that an axlebox suspension system with longitudinal stiffness is provided between a truck frame and an axlebox in order to prevent snaking from occurring at the time of high-speed running on a straight line portion. Further, in view of mechanism, the opposite ends of the axle are elastically fastened to the truck frame. As a result, in the case where the respective axles are to be directed to the center of the curve when the axles pass the curve in the railroad, force exceeding the elastic force of suspension is required to be transmitted. Therefore, a mechanism for connecting the axles and the truck frame through links is used, for example, as described in JP-A-5-77730.

Those systems become, however, so complex in structure as to bring increase in weight, production cost and maintenance cost in comparison with ordinary trucks. Accordingly, those systems are only used for a limited purpose of special express trains such as JR Hokkaido 283 railroad motor cars, or the like, requiring a high-speed operation.

An object of the present invention is therefore to provide an axlebox suspension system in which the aforementioned motion of the axles can be performed by paying attention to the characteristic of axles in that rotational displacement in a horizontal plane around the respective centers of gravity of the axles is made, while keeping the distance between the centers of the axles constant with respect to a truck frame in the case where the axles are turned toward the center of a curve in the railroad.

SUMMARY OF THE INVENTION

In order to achieve the above object, according to a first aspect of the present invention, there is provided by an axlebox suspension system in which each axle is contained within a perpendicular cylindrical surface with the center of gravity of a corresponding wheelset as its center with respect to a truck frame to thereby prevent the axle from moving longitudinally as a whole and allow the axle to displace in the direction of turning in a horizontal plane (hereinafter referred to as "in-horizontal-plane turning").

According to a second aspect of the present invention, a laminated rubber spring body having, as a guide, a part of a perpendicular cylinder with the center of gravity of the wheelset as its center is disposed between a truck frame and an axlebox to thereby make it possible to perform transmission of tractive force.

Incidentally, in this case, torsional stress acts on an axle spring portion. Another laminated rubber spring body formed in a corrugated section in the direction of in-horizontal-plane turning of the wheelset may be configured to be inserted in series to the axle spring to prevent the axle spring from being deformed excessively by the torsional stress.

According to a third aspect of the present invention, a damping force acting element such as an oil damper, or the like, is provided additionally to prevent resonance caused by making the axle capable of performing an in-horizontal-plane turning motion. There arises an effect that safe running performance is obtained.

According to a fourth aspect of the present invention, there is provided a mechanism for locking the in-horizontal-plane turning of the axle in a necessary case, for example, when a vehicle runs on a straight line portion at a high speed or when a sudden brake force or the like is applied in such a way as to be unbalanced at the right and left. There arises an effect that a snaking motion, or the like is prevented.

According to a fifth aspect of the present invention, the axlebox suspension system has such a characteristic that the wheelset makes an in-horizontal-plane turning displacement relative to the truck frame. Accordingly, when the axlebox suspension system is applied to a forced steering truck and when a rotation motor having a speed reducer is driven by a quantity of turning displacement necessary for each axle on the basis of an output of an arithmetic unit, the axle can be turned toward the center of a curve in the railroad.

As described above, according to the present invention, yawing restriction between a wheelset and a truck frame, which is a problem in a conventional bogie truck, is released so that the wheelset can rotate in a horizontal plane around the center of gravity of the wheelset relative to the truck frame so as to turn toward the center of a curve in the railroad. Furthermore, such a mechanism can be achieved without additional provision of any special mechanism in comparison with the conventional truck. Accordingly, a remarkable effect can be achieved on improvement in reduction of lateral pressure at the time of passage of the wheels through a curve in the railroad, improvement in prevention of abrasion of wheel flanges and rails and improvement in prevention of squeaking noise of wheels.

BEST MODE FOR CARRYING OUT THE INVENTION

An embodiment of the present invention will be described below in detail with reference to the drawings.

Figure 1A:
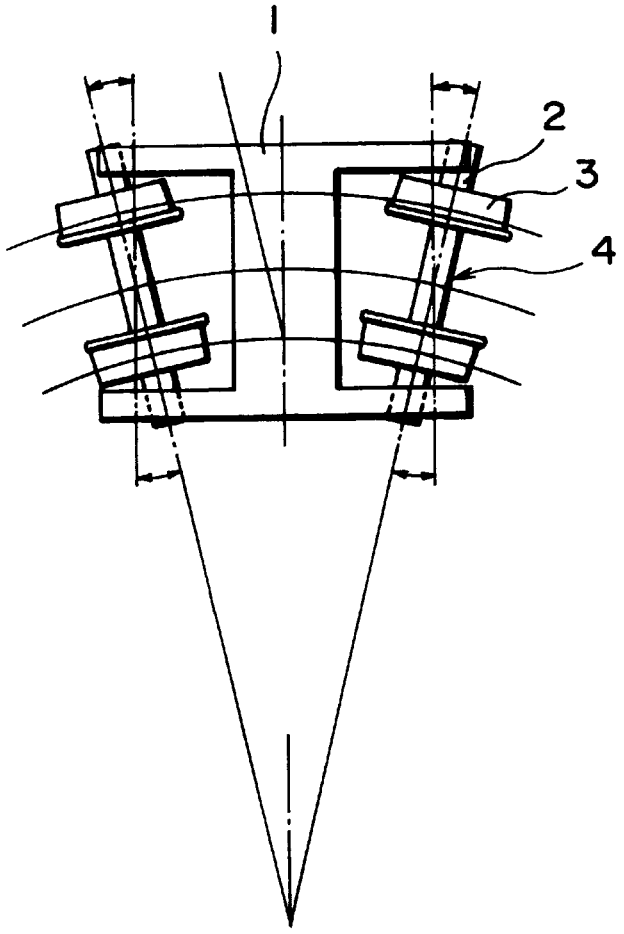
FIG. 1A shows an ideal state of a truck at its passage through a curve in the railroad in the case where an axlebox suspension system according to the present invention is attached to the truck.
Figure 1B:
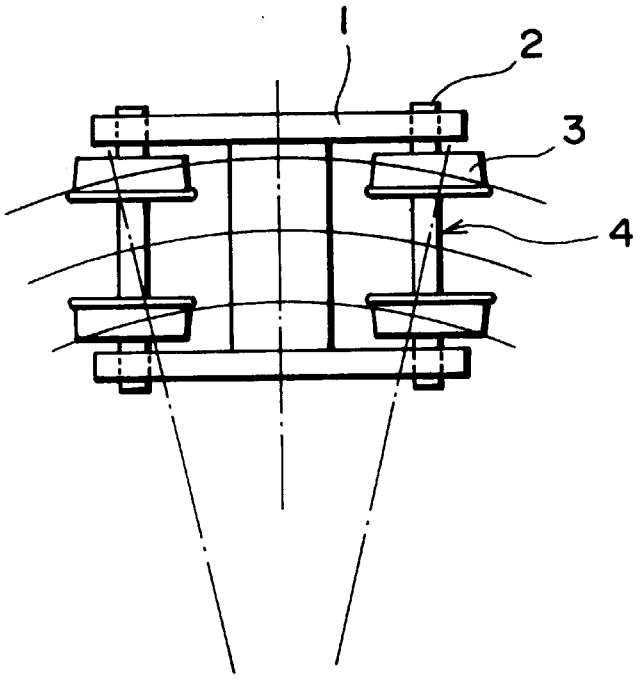
FIG. 1B typically shows a state of a conventional truck at the time of its passage through a curve in the railroad at a very low speed.

FIG. 1A shows an ideal state of a truck at the time of its passage through a curve in the railroad in the case where an axlebox suspension system according to the first aspect of the present invention is attached to the truck, whereas FIG. 1B typically shows a state of a conventional truck at its passage through a curve in the railroad at a very low speed. When a truck enters into a curved portion at a high speed, wheels are turned toward the inside of the curve in the railroad by the reaction force due to the contact of flange of the wheel with an outer rail. This fact expresses that the restriction force of the axlebox suspension system acting on axle end portions functions as force which attempts to keep the two axles in parallel with each other, as shown in FIG. 1B.

The truck according to the present invention is compared with the conventional truck as follows. In the conventional truck, force acts on the two axles 2 to keep the two axles 2 in parallel with each other at the time of passage of the truck through a curve in the railroad, as shown in FIG. 1B, because the respective opposite end portions of the axles 2 are elastically coupled with a truck frame 1. On the contrary, in the truck according to the first aspect of the present invention, an ideal state in which the wheels are arranged along the curved rails, as shown in FIG. 1A, can be achieved by the axlebox suspension system without provision of any special mechanism in addition to the conventional system because the axlebox suspension system has a function to allow each wheelset to turn horizontally around the center of gravity of the wheelset.

The mechanism for allowing the wheelsets 4 to turn horizontally according to the present invention will be described with reference to FIG. 2. Surfaces curved around the center O of gravity of each wheelset 4 and forming partial portions of a cylindrical surface A perpendicular to the plane of the drawing are formed as guides in the axlebox 5 side and in the truck frame 1 side, respectively. By this measure, the wheelset 4 is guaranteed to turn horizontally around the center O of gravity of the wheelset 4 within a predetermined range.

Theoretically, there is a system in which partial curved portions of the perpendicular cylindrical surface A are formed in the axlebox 5 side and in the truck frame 1 side, respectively, and the two partial curved portions are made to be in slidable contact. According to the second aspect of the present invention, in each side of the wheelset, a space between the two curved surfaces in the axlebox 5 side and in the truck frame 1 side in FIG. 2 is filled with a laminated rubber spring body 10 formed from curved metal plates 11 and curved rubber layers 12 laminated alternately as shown in FIG. 3. Accordingly, the axlebox body 5' and the truck frame 1 are coupled with each other through the laminated rubber spring body 10. For example, four screwed studs 7 secured to each of the outer curved metal plates 13 of the laminated rubber spring body 10 have screw portions projecting from the curved surface. The screw portions of the studs 7 are inserted into four holes provided in the curved surface 5*a* of the axlebox body 5' forming a part of the aforementioned perpendicular cylindrical surface A and are fastened with nuts 9, so that the laminated rubber spring body 10 according to the present invention as shown in FIG. 3 is fixed to the axlebox body 5'. Flat plate 5*b* of the axlebox body 5' is fixed to a side surface of the axlebox 5, as is obvious from FIG. 2. Screw portions at ends of the studs 7 projecting to a side opposite to the axlebox body 5' are fixed to the truck by nuts 14 as will be described later.

The laminated rubber spring body per se, which is shaped variously and which is used for absorbing vibration propagating in the truck, is well known. The laminated rubber spring body 10 according to the present invention is, however, quite different from the prior art in the purpose of use, the shape thereof and the arrangement thereof.

Generally, the laminated rubber spring body has such a characteristic that the laminated rubber spring body is less deformed in the rubber compressing direction but is allowed to be more greatly deformed in the rubber shearing direction. Accordingly, the laminated rubber spring body 10 according to the present invention not only has a characteristic of absorbing the vertical motion of rail joints, points, or like, to thereby allow the wheelset 4 to make an in-horizontal-plane turning displacement relative to the truck frame 1 at the time of passage of the truck through a curve in the railroad but also has a predetermined restoring force characteristic. Further, because the laminated rubber spring body 10 forms a part of the cylindrical surface A, a compression component in the direction of movement, of stress acting on the laminated rubber spring body 10, fulfills a tractive force transmission function with respect to the acceleration/deceleration of a vehicle.

The operation of the truck having the axlebox suspension system according to the present invention will be described below. As described preliminarily in the prior art, when a wheelset 4 having a pair of wheels 3 enters into a curved portion of the railroad, the wheelset 4 is made to move toward the outside of the curve in the railroad by centrifugal force to generate a difference between the radii of the inner and outer wheels correspondingly to the wheel tread. Accordingly, the outer wheel advances forward relatively, so that the wheelset 4 can run smoothly on the curved portion without occurrence of excessive sliding of the wheels 3 on the rails. The axlebox suspension system according to the present invention operates to facilitate such displacement. FIG. 1A shows this state. It is obvious from FIG. 1A that the wheelset 4 must rotate horizontally relative to the truck frame 1 and force of restricting the axle 2 toward the in-horizontal-plane turning direction is generated at opposite end portions of the axle 2 in the conventional truck by means of the axlebox suspension system. As described above, the axlebox suspension system according to the present invention has an effect that facilitation of displacement of the wheelset 4 in the in-horizontal-plane turning direction guarantees the necessary rotation of the wheelset 4 relative to the truck frame 1 at the time of passage of the truck through a curve in the railroad to thereby give self-steering performance to the truck.

FIGS. 2 through 6 show the case where the axlebox suspension system according to the second aspect of the present invention is applied to a so-called axle spring type truck.

Figure 2:
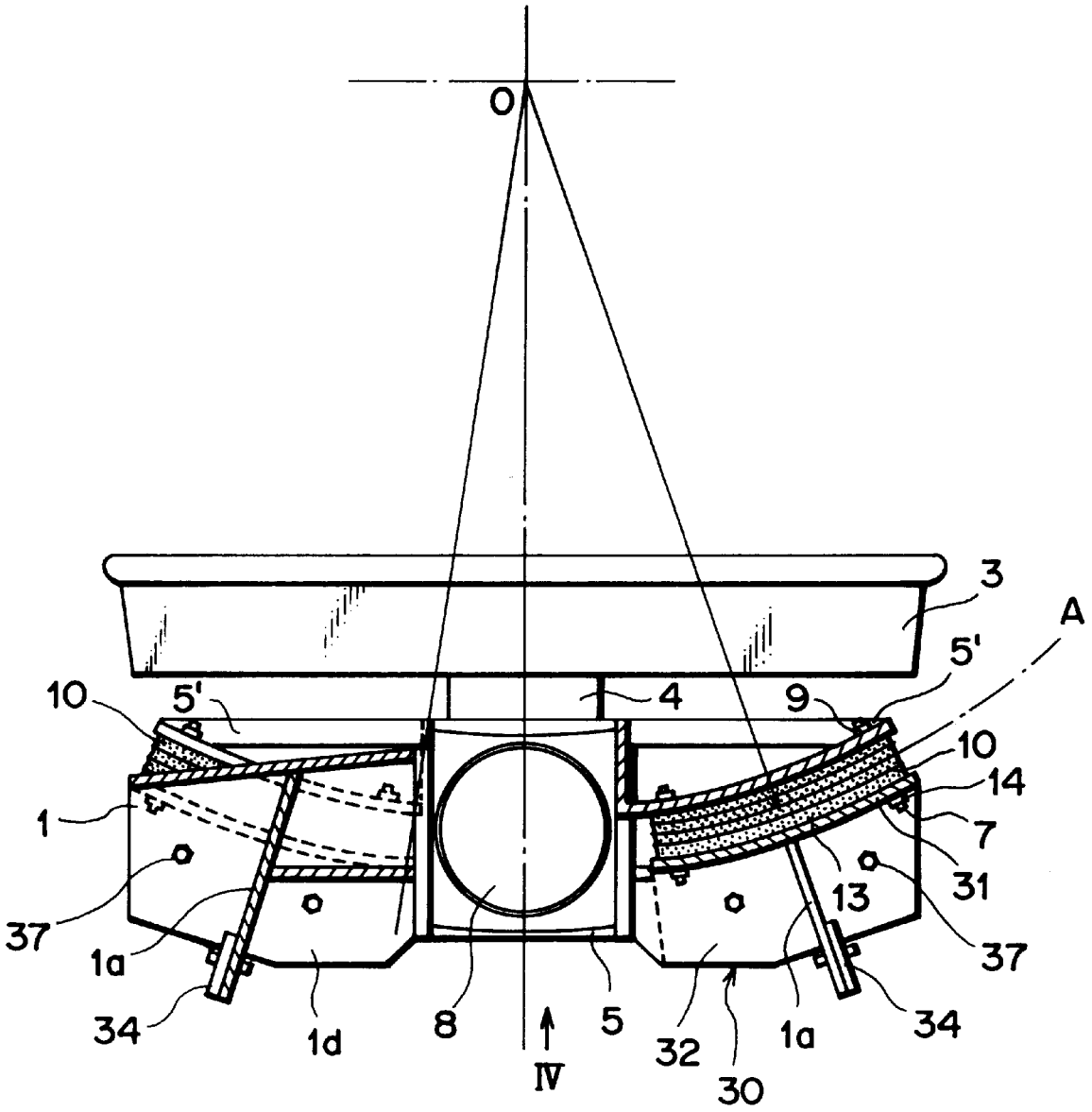
FIG. 2 shows a structure in which axlebox suspension systems each having, as a guide, a partial curved surface of a perpendicular cylindrical surface A with the center of gravity of a wheelset as its center according to the present invention, are attached to opposite sides of an axlebox, the left half of FIG. 2 showing a section of a truck frame, the right half of FIG. 2 showing a section of only a laminated rubber spring body mounting portion.
Figure 3:
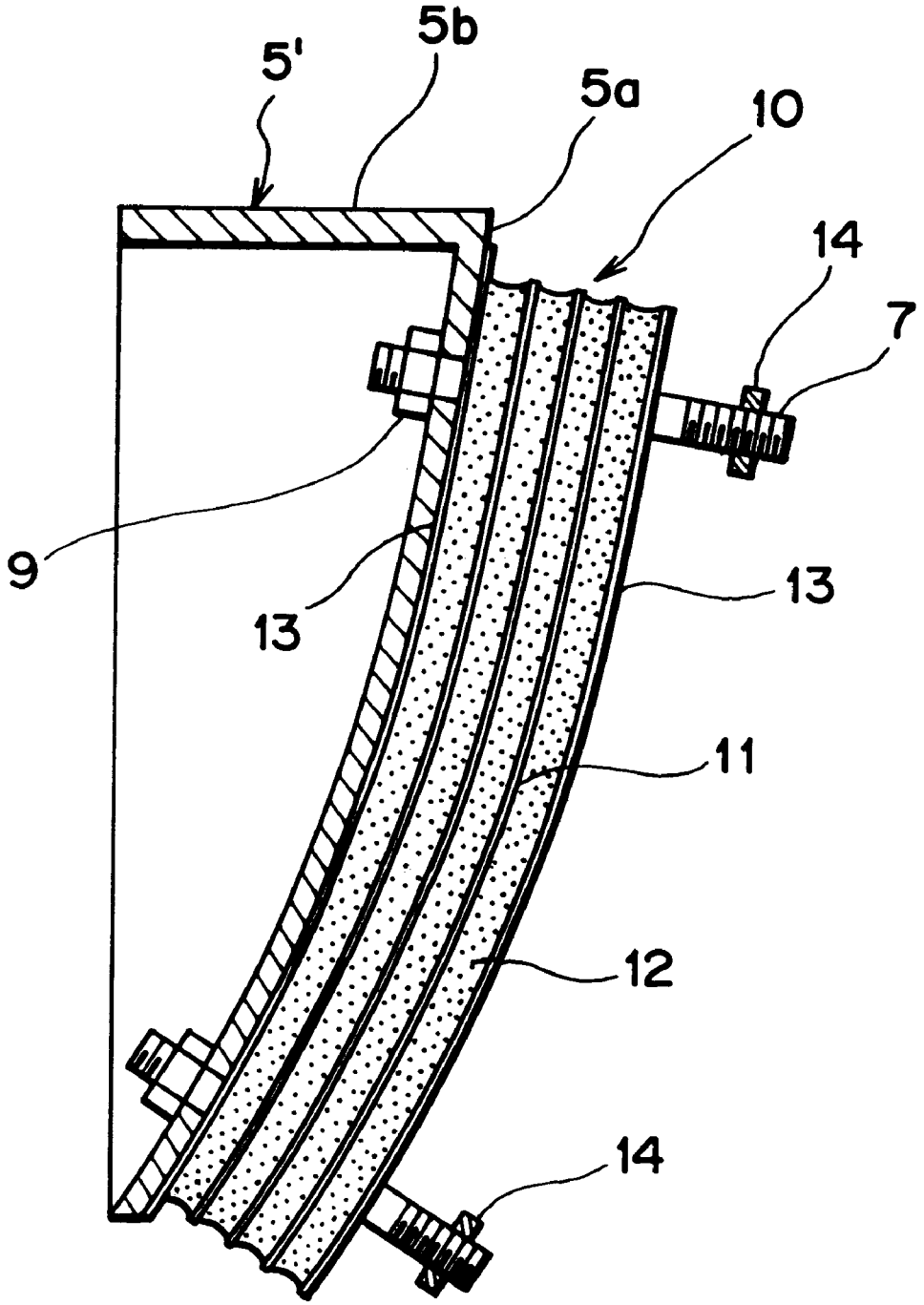
FIG. 3 shows a structure in which a laminated rubber spring body having a part of a cylinder as a guide is mounted on an axlebox body.
Figure 4:
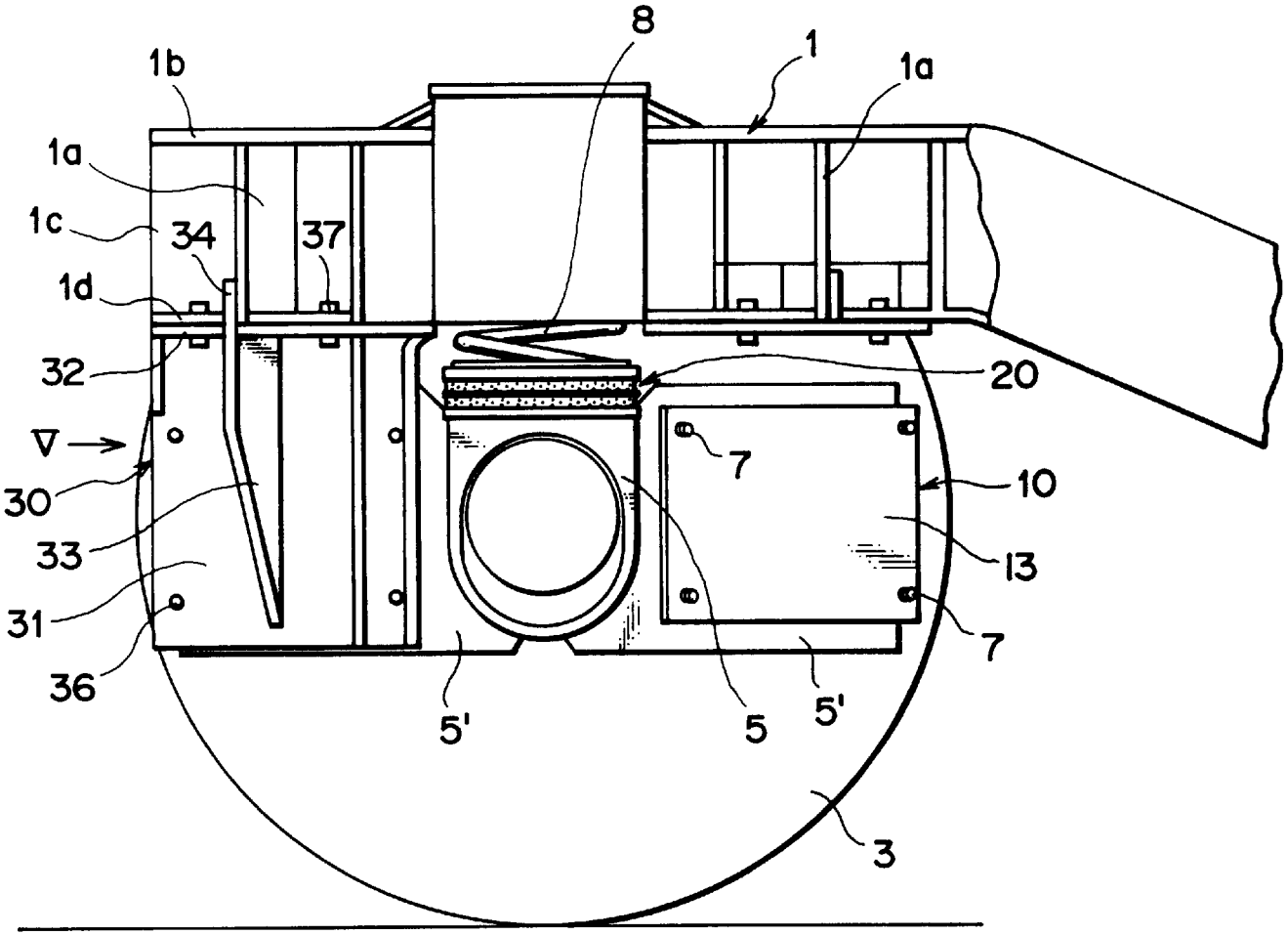
FIG. 4 is a front view viewed from the direction of the arrow IV in FIG. 2.
Figure 5:
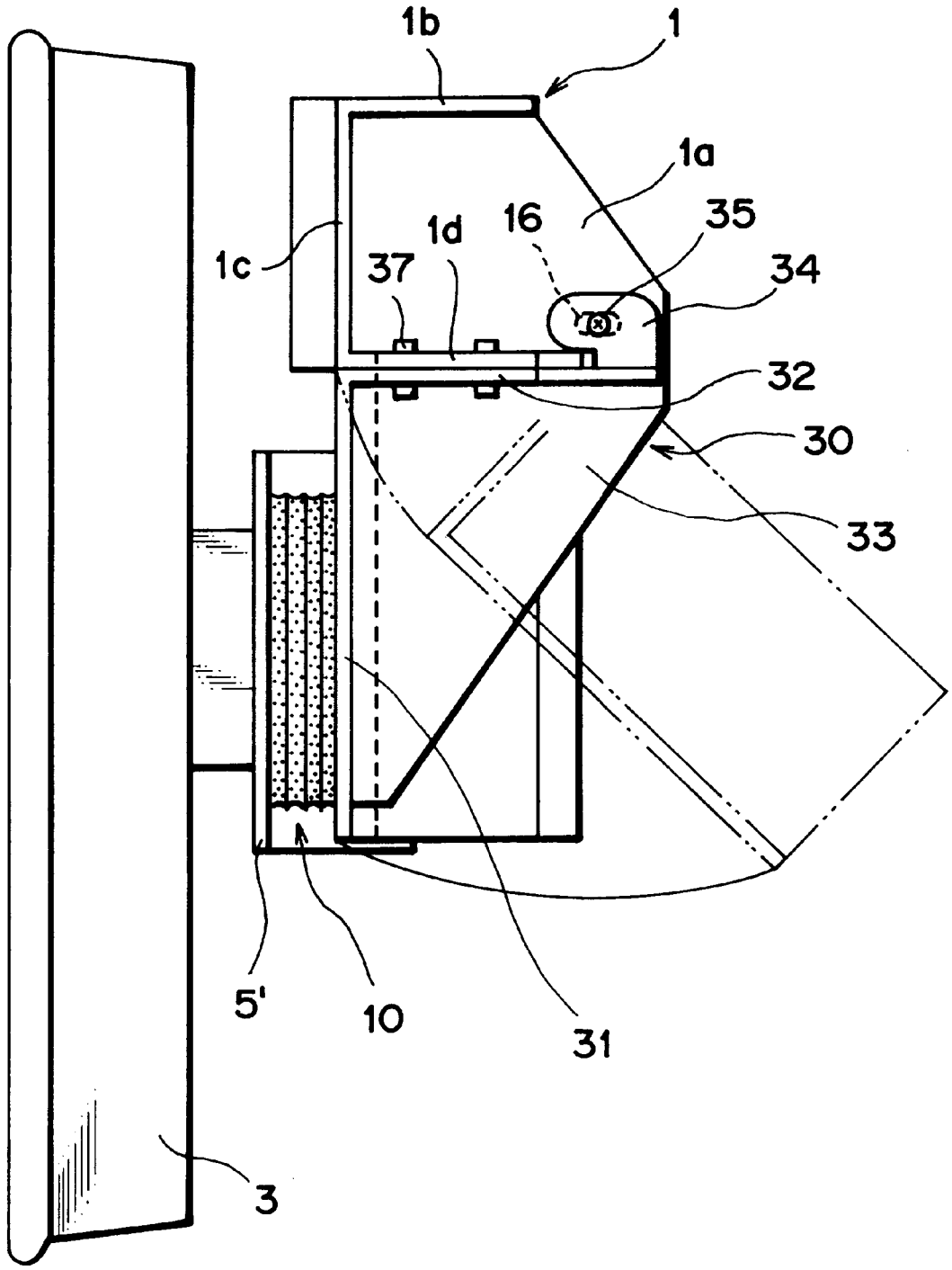
FIG. 5 is a side view viewed from the direction of the arrow V in FIG. 4.

In FIGS. 2 through 4, rib plate la (see FIG. 2) extending obliquely in directions of passing through the center O of gravity of the wheelset 4 is provided on the opposite sides of the truck frame 1 so that the axlebox 5 is disposed between the opposite sides of the truck frame 1. The rib plate 1*a* is welded to an upper plate 1*b,* a back plate 1*c* and a lower plate 1*d* of the truck frame 1. In protrusion side lower end portions of the rib plate 1*a,* laterally elongated holes 1*e* are formed in predetermined positions. On the other hand, the laminated rubber spring body 10 (see FIG. 3) attached to the axlebox body 5' and the truck frame 1 can be coupled with each other by any suitable method. In this illustrated embodiment, a truck side laminated rubber spring body mounting member 30 provided as another block between the laminated rubber spring body 10 and the truck frame 1 is used. The member 30 is constituted by a perpendicular curved plate 31 corresponding in curvature to a curved metal surface 13 (see FIG. 2) forming a part of a perpendicular cylindrical surface on a side opposite to the laminated rubber spring body 10 side fixed to the axlebox body 5', a horizontal plate 32 extended horizontally from the perpendicular curved plate 31 and attached to the lower plate 1*d* of the truck frame 1, and a stay 33 fixed between the perpendicular curved plate 31 and the horizontal plate 32 and extended obliquely toward the center of gravity of the wheelset while being adjacent to the rib plate 1*a* of the truck frame 1. A suspension ear 34 extends upward from an upper end outer edge of the stay 33 via a notch of the horizontal plate 32 and a notch of the lower plate 1*d* of the truck frame. In the suspension ear 34, a loose hole is formed in a position corresponding to the laterally elongated hole 1*e* of the rib plate 1*a* of the truck frame 1 so that the truck side laminated rubber spring body mounting member 30 as another block can be suspended by a bolt 35. Incidentally, four through holes 36 are formed in the perpendicular curved plate 31 so that the end screw portions of the studs 7 projecting from the metal surface 13 of the laminated rubber spring body 10 are made to pass through the holes 36. In such a configuration, in order to connect and fix the truck frame 1 to the laminated rubber spring body 10, which is already fixed to the axlebox body 5', through the truck side laminated rubber spring body mounting member 30 suspended from the truck frame 1, the truck side laminated rubber spring body mounting member 30 is turned around the bolt 35 toward the laminated rubber spring body 10. At that time, in order to make the screw end portions of the studs 7, which project from the laminated rubber spring body 10, pass through the through holes 36 of the perpendicular curved plate 31 of the truck side laminated rubber spring body mounting member 30, the bolt 35 of the suspension ear 34 is pulled toward the front side along the laterally elongated hole 1*e* of the rib plate 1*a* of the truck frame 1 and then the perpendicular curved plate 31 is pressed against the studs 7 side again. Thereafter, the nuts 14 are screwed tightly onto the screw end portions of the studs 7 projecting from the perpendicular curved plate 31 abutting on the curved surface 13 of the laminated rubber spring body 10, and, at the same time, the lower plate 1*d* of the truck frame 1 and the horizontal plate 32 of the truck side laminated rubber spring body mounting member 30 abutting on the lower plate 1*d* are fastened and fixed to each other by bolts and nuts 37. Thus, an effect to make the operation of assembling and disassembling the truck safe and easy can be achieved.

Figure 6:
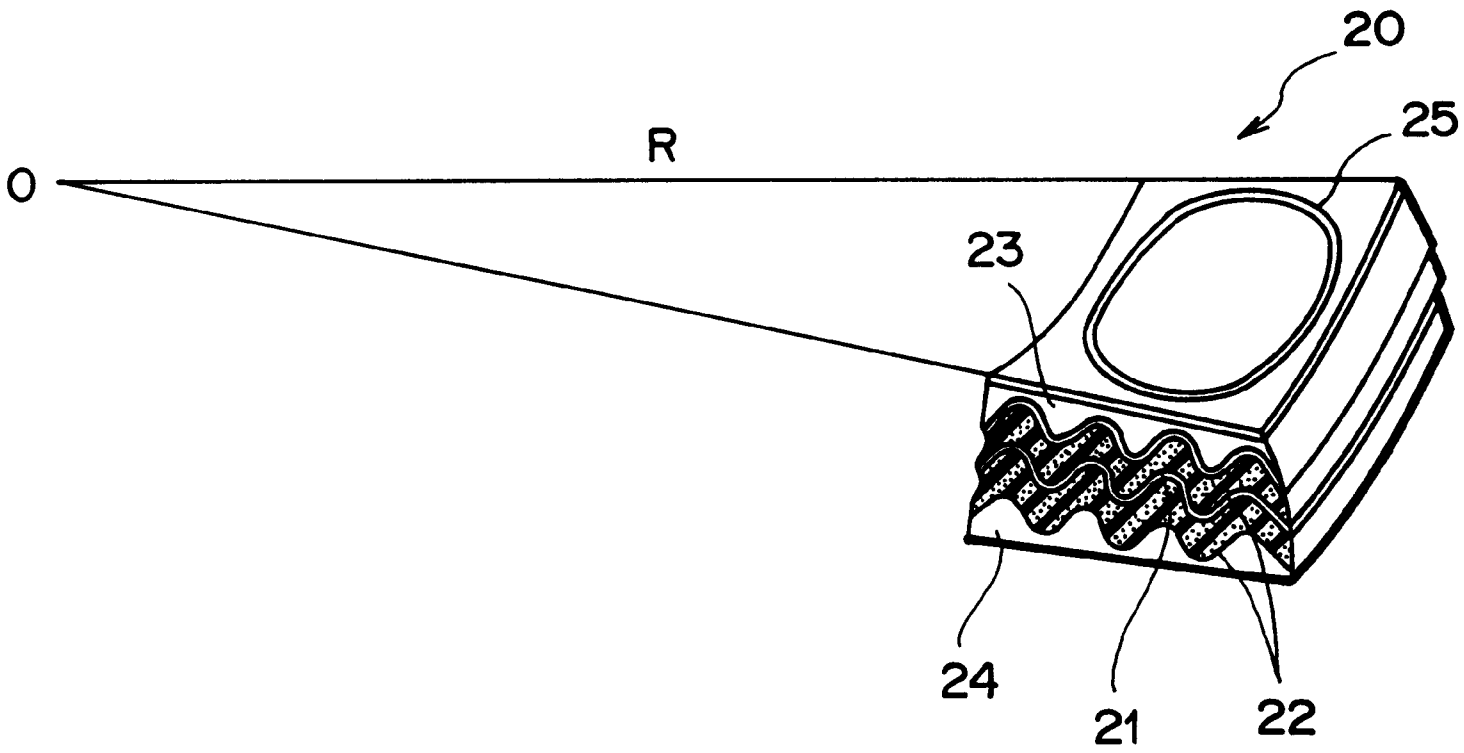
FIG. 6 is a perspective view showing the shape of another laminated rubber spring body disposed in series to an axle spring.

In order to make the axle spring 8 in the axle box the in-horizontal-plane turning displacement of the wheelset 4 through the distortional deformation of the axle spring 8 in the case where the axlebox suspension system according to the present invention is applied to an axle spring type truck, an effect of smoothing the horizontal displacement of the wheelset 4 can be achieved by disposing the axle spring 8 in series to another laminated rubber spring body 20 having a characteristic that it is deformed easily only in the in-horizontal-plane turning direction of the wheelset 4, as will be more clear from FIG. 4. FIG. 6 is a perspective view showing the laminated rubber spring body 20. The laminated rubber spring body 20 is constituted by a corrugated metal plate 21 parallel with the direction of in-horizontal-plane turning of the axle around the center O of gravity of the wheelset 4, two sheets of corrugated rubber laminates 22 piled up one on the other through the corrugated plate 21, and upper and lower metal plates 23 and 24 having corrugated inner surfaces corresponding to the corrugated rubber laminates 22. Incidentally, a ring-like groove or protrusion 25 is formed in the uppermost metal plate 23 so that the lower end of the axle spring 8 is fitted to the ring-like groove or protrusion 25. As described above, the laminated rubber spring body 20 is deformed easily in the in-horizontal-plane turning direction by the corrugated guides parallel with the direction of in-horizontal-plane turning of the wheelset around the center of gravity thereof.

Figure 7:
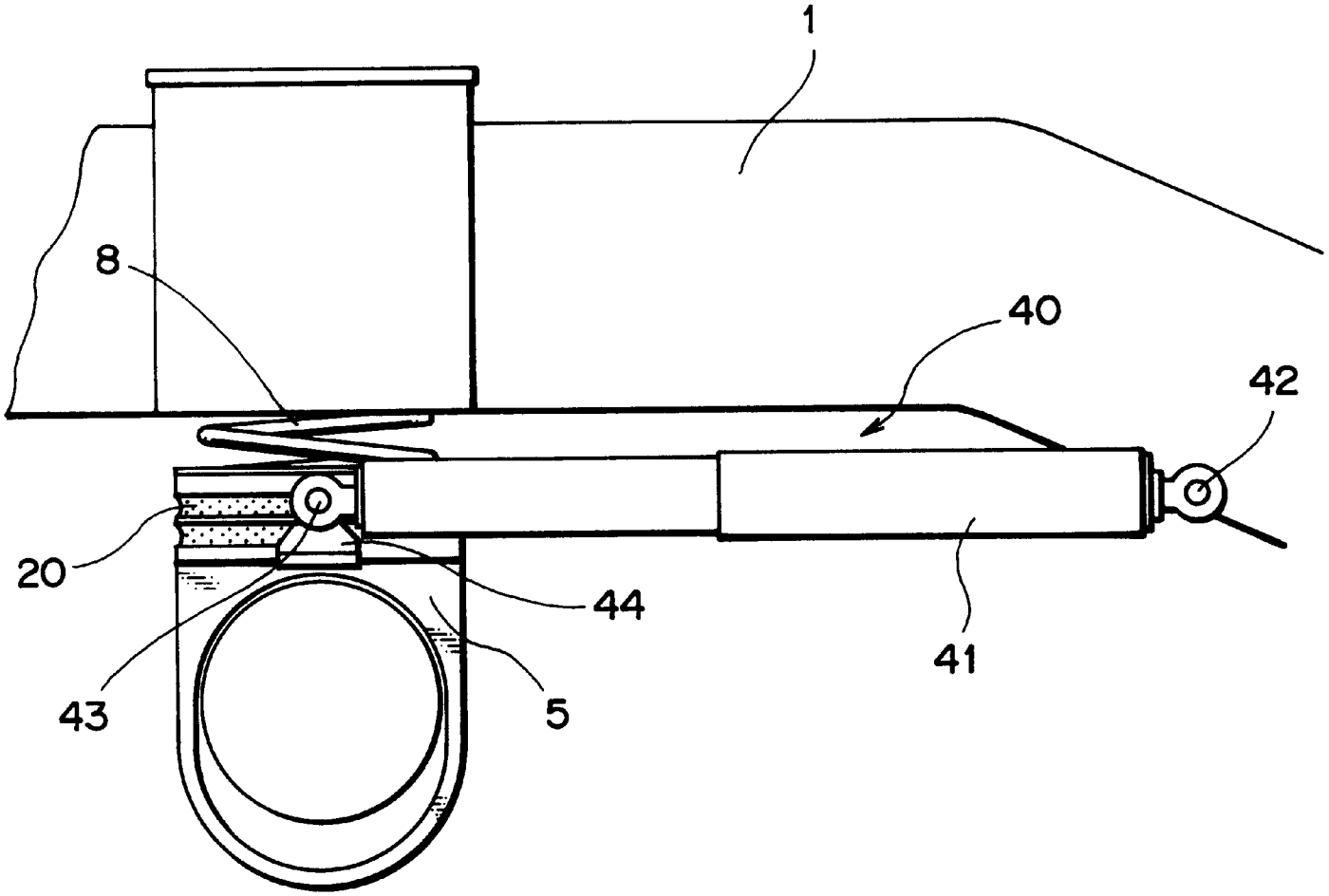
FIG. 7 shows a structure in which a damping force acting element is disposed between a truck frame and an axlebox to prevent the occurrence of a resonance phenomenon caused by the in-horizontal-plane turning motion of the wheelset.

FIG. 7 shows the third aspect of the present invention. Because the axlebox suspension system according to this aspect of the present invention is designed to allow the wheelset 4 to make an in-horizontal-plane turning motion, the occurrence of a resonance phenomenon is required to be prevented, and since each of ends of the wheelset makes a reciprocating motion on a circular arc, an oil damper as a damping force acting element 40 due to linear approximation is disposed between the truck frame 1 and the axlebox 5. A cylinder 41 of the oil damper 40 is pivoted on the truck frame 1 by means of a pin 42 and the rod side of the oil damper 40 is pivoted on a protrusion 44 of the axlebox 5 by means of a pin 43. Incidentally, the reference numeral 8 designates the axle spring and 20 designate the other corrugated laminated rubber spring body.

Figure 8:
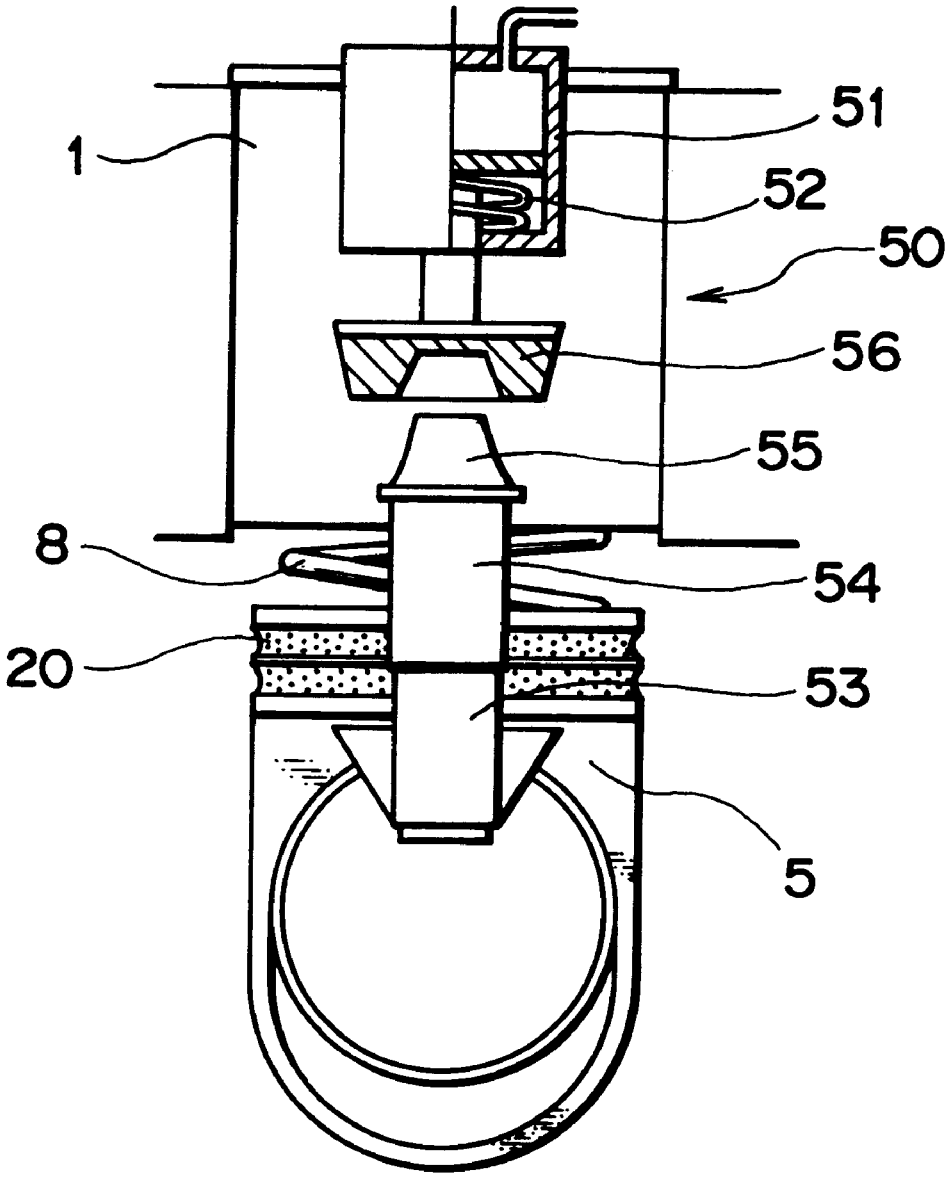
FIG. 8 is a partly sectional front view of a locking mechanism for canceling the degree of freedom in the in-horizontal-plane turning of the wheelset when a vehicle runs on a straight line portion in the railroad at a high speed or when a sudden brake force is applied.
Figure 9A:
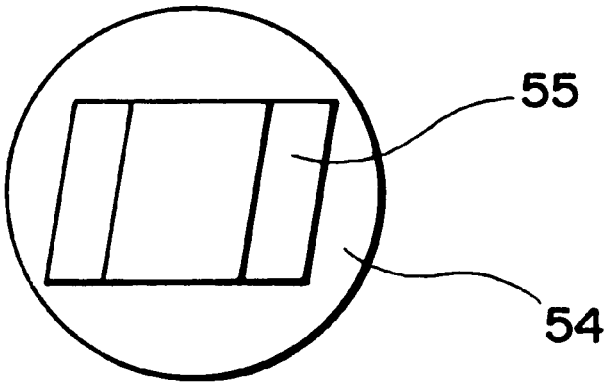
FIG. 9A is a plan view of an interlocking male helical tooth which is adapted to engage a lock portion having a female helical tooth of FIG. 8.
Figure 9B:
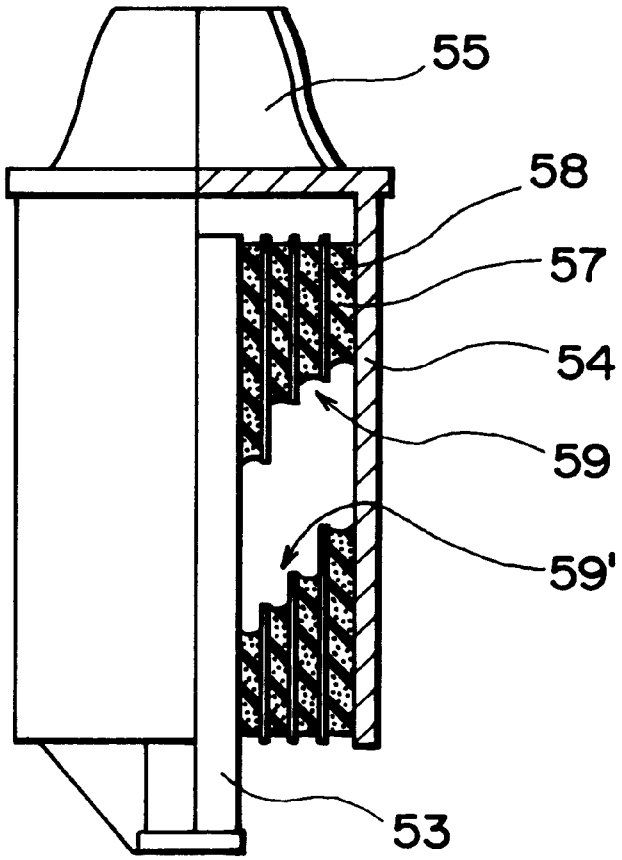
FIG. 9B is a front (left half) view containing a section (right half) in the case where a cylindrical guide portion is formed of cylindrical rubber.

FIG. 8 shows the fourth aspect of the present invention, and illustrates an example of a locking mechanism 50 for canceling the degree of freedom in the in-horizontal-plane turning of the wheelset 4 as occasion demands, for example, when the vehicle runs on a straight line portion at a high speed or when a sudden brake force is applied in such a way as to be unbalanced at the right and left. These locking mechanism 50 uses a locking system in which compressed air is fed into an air cylinder 51 with a return spring to thereby perform locking. It is; however, possible to consider an idea to use a return spring 52 reversibly so as to use air pressure in the unlocking side. Incidentally, smooth locking can be made if the interlocking portion of the lock mechanism is shaped like a helical gear as shown in plan of FIG. 9A. FIG. 9A shows, as an embodiment, a lock system in which a helical gear stopper 55 is attached to an upper portion of an outer cylindrical guide 54 vertically movably fitted onto the outer circumference of an inner cylindrical guide 53 which is attached to the axlebox 5, so that the helical gear stopper 55 is interlocked to a locking portion 56 which has a concave portion of corresponding helical gear shape and which is moved down by the air cylinder 51 provided with a return spring and fixed to the truck frame 1 just above the helical gear stopper 55. Further, this cylindrical guide may be constituted by such a cylindrical rubber system as shown in FIG. 9B or by an oil damper for axle spring.

The cylindrical rubber system shown in FIG. 9B will be described below. Rubber cylinders 57 and metal cylinders 58 are laminated alternately in the radial direction. Thus, an upper cylindrical rubber laminate 59 is formed so that its axial length increases downward as its position radially approaches the center from the outside, while a lower cylindrical rubber laminate 59' is formed reversibly so that its axial length increases upward as its position radially approaches the outside from the center. The outermost cylindrical rubber is fixed to the outer cylindrical guide 54 whereas the innermost cylindrical rubber is fixed to the inner cylindrical guide 53. The inner cylindrical guide 53 is movable vertically in the axial direction relative to the outer cylindrical guide 54 because of the elasticity of the cylindrical rubber.

Figure 10:
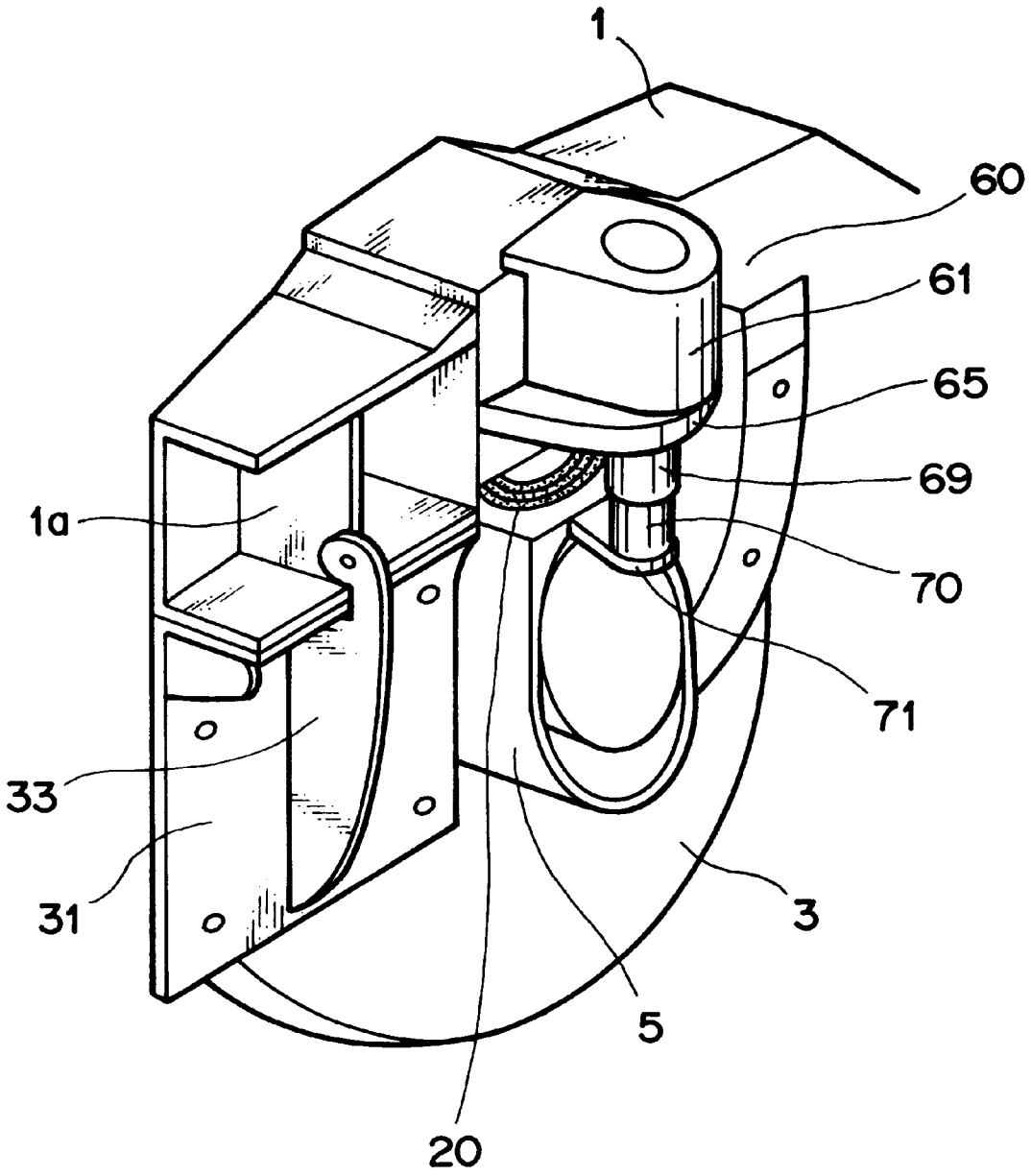
FIG. 10 is a perspective view of a steering mechanism for direct drive control of the rotation of an axlebox with the center of gravity of a wheelset as its center by means of a rotation motor provided with a speed reduction mechanism and fixed to a truck frame, showing the case where the axlebox suspension system according to the present invention is applied to a forced steering truck.

FIG. 10 shows the fifth aspect of the present invention, and illustrates an example of the case where the axlebox suspension system according to the present invention is applied to a forced steering truck. Because an end of the axlebox 5 has a characteristic of making a circular motion around the center of gravity of the wheelset, the rotation of the axlebox 5 can be directly controlled by a rotation motor 61 which is provided with a built-in speed reduction gearing mechanism and which is fixed to the truck frame 1.

Figure 11:
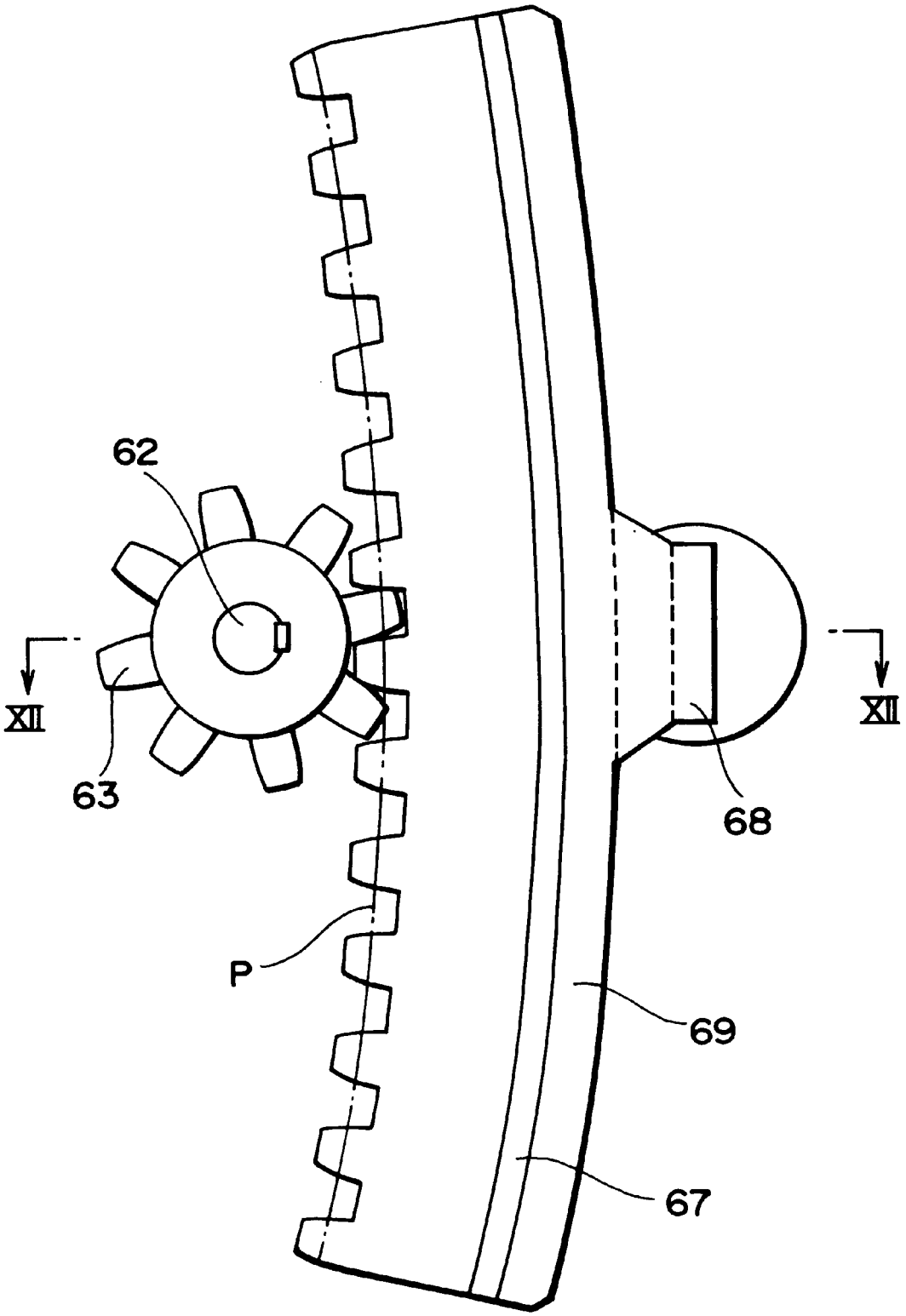
FIG. 11 is a plan view showing a structure in which an end of an axlebox is rotated in a housing in the axlebox rotation drive control mechanism depicted in FIG. 10.
Figure 12:
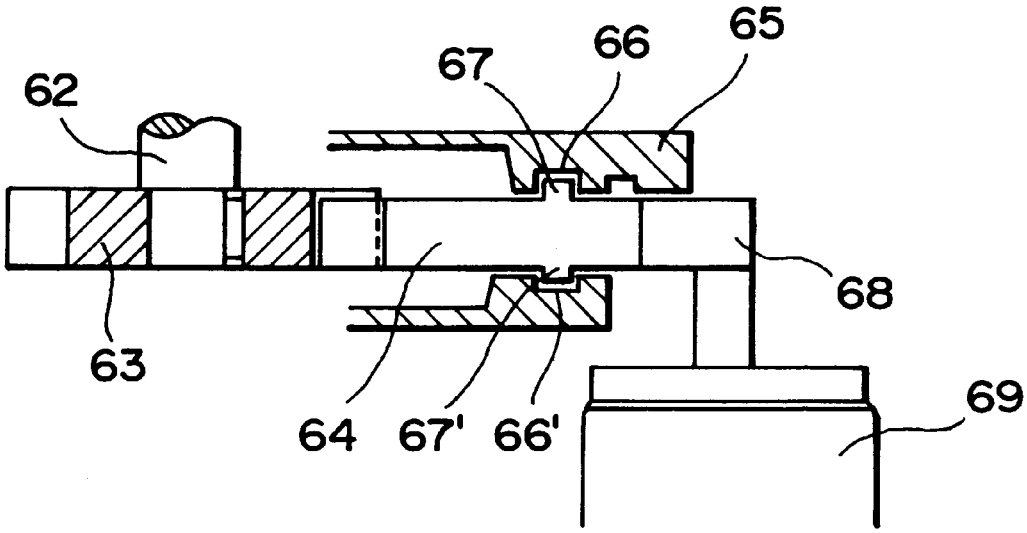
FIG. 12 is a partly sectional view cut away along the line XII—XII in FIG. 11.

In detail, as shown in FIGS. 11 and 12, a pinion 63 is mounted on an output shaft 62 of the motor 61 fixed to the truck frame 1 and, on the other hand, a circular arc-shaped internal gear 64 which makes a in-horizontal-plane turning motion around the center of gravity of the wheelset and which has a circular arc-shaped curve P as a pitch circle is geared with the pinion 63. In order to guide the circular arc-shaped internal gear 64 to move circularly, circular arc-shaped grooves 66 and 66' are respectively provided in opposition to each other in the upper and lower inner walls of a housing 65 fixed to the truck frame 1 on one hand, and circular arc-shaped protrusion lines 67 and 67' are provided on the circular arc-shaped internal gear 64 so as to be slidably fitted to the circular arc-shaped grooves 66 and 66' which are concentric with the pitch circle. An L-shaped protrusion 68 is formed at the center on the opposite side to the teeth of the circular arc-shaped internal gear 64. A downward extending portion of the L-shaped protrusion 68 is fixed to an outer cylindrical guide member 69. The outer cylindrical guide member 69 is vertically slidably fitted to an inner cylindrical guide member 70. A lower end of the inner cylindrical guide member 70 is fixed to a protrusion 71 which projects outward from the axlebox 5. Incidentally, this cylindrical guide may be constituted by such a cylindrical rubber system as shown in FIG. 9B or by an oil damper for axle spring.

By the aforementioned configuration, the quantities of displacement of respective axles can be calculated correspondingly to the curve through which the axles pass, so that the rotational displacement of the wheelsets can be on-line controlled. Accordingly, it is possible to achieve an effect of remarkably improving the running performance on a curve in the railroad at a high speed.

INDUSTRIAL UTILITY

Because the axlebox suspension system according to the present invention is configured in such a manner as described above, the axlebox suspension system is particularly adapted to a truck requiring a steering function. In detail, the axlebox suspension system according to the first and second aspects of the present invention is configured so that the in-horizontal-plane turning displacement of the wheelset relative to the truck frame can be performed smoothly on a curve in the railroad. Accordingly, remarkable improvement is obtained in reduction of lateral pressure at the time of passage of the truck through a curve in the railroad, prevention of abrasion of wheel flanges and rails and prevention of squeaking noise of wheels. Accordingly, self-steering property is enhanced remarkably.

Further, improvement in performance of passage of the truck through a curve in the railroad can be achieved without requiring any complex mechanism or any large number of parts. Accordingly, the cost of maintenance of both the vehicle and track can be reduced.

In the axlebox suspension system according to the third and fourth aspects of the present invention, stable running can be achieved by the damping force acting element or the locking mechanism against resonance which may be caused by the configuration allowing each wheelset to make an in-horizontal-plane turning motion.

When the axlebox suspension system according to the present invention is applied to a forced steering truck and when the configuration is made so that the rotation of the axlebox can be directly drive-controlled according to the fifth aspect of the present invention, the quantities of displacement of respective axles corresponding to the curvature of a curve through which the axles pass can be calculated so that the rotational displacement of the wheelsets can be on-line controlled. Accordingly, remarkable improvement in reasonability and quickness of controlling can be achieved in comparison with the conventional link system.

What is claimed is:

1. An axlebox suspension system for a bogie truck, said axlebox suspension system comprising:

means for allowing each wheelset to vibrate freely only in a direction of in-horizontal-plane turning around the center of gravity of said wheelset comprising a first laminated rubber spring body having as a guide, a curved shape forming a part of a circular arc of a perpendicular cylinder with the center of gravity of a wheelset as its center and disposed to front and rear direction side, relative to the direction of movement of the wheelset, of the axlebox; and a second laminated rubber spring body corrugated in the direction toward the center of gravity of the wheelset, laminated in the direction parallel to the in-horizontal-plane turning of the axle around the center of the wheelset and disposed in series to an axle spring.

2. The axlebox suspension system according to claim 1, wherein the first laminated rubber spring body is disposed between the curved surface of an axlebox body and a curved surface of a perpendicular curved plate comprising a laminated rubber spring mounting member, said surfaces forming a part of a circular arc of a perpendicular cylinder having the center of gravity of the wheelset as its center.

3. The axlebox suspension system according to claim 1 or 2, wherein said system further comprises a damping force acting element thereof.

4. The axlebox suspension system according to claim 1 or 2 wherein said system further comprises a steering mechanism having a function of setting a rotation angle for each axle.

5. An axlebox suspension system for a bogie truck, said axlebox suspension system comprising:

means for allowing each wheelset to vibrate freely only in a direction of in-horizontal-plane turning around the center of gravity of said wheelset comprising a first laminated rubber spring body having, as a guide, a curved shape forming a part of a circular arc of a perpendicular cylinder with the center of gravity of a wheelset as its center and disposed to front and rear direction side, relative to the direction of movement of the wheelset, of the axle box;

a second laminated rubber spring body corrugated in the direction toward the center of gravity of the wheelset, laminated in the direction parallel to the in-horizontal-plane turning of the axle around the center of the wheelset and disposed in series to an axle spring; and a mechanism for locking the function of said system.

* * * * *